US005839911A

United States Patent [19]

Dinkel

[11] Patent Number: 5,839,911

[45] Date of Patent: Nov. 24, 1998

[54] ADJUSTABLE AND RELEASABLE STRAIN RELIEF

[75] Inventor: Jeffrey Allen Dinkel, Greensboro, N.C.

[73] Assignee: The Whitaker Corporation, Wilmington, Del.

[21] Appl. No.: 790,355

[22] Filed: Jan. 24, 1997

[51] Int. Cl.[6] ..... H01R 13/58

[52] U.S. Cl. ..... 439/470

[58] Field of Search ..... 439/470, 471, 439/472, 901, 465, 467

[56] References Cited

U.S. PATENT DOCUMENTS

| | | | |
|---|---|---|---|
| 3,290,430 | 12/1966 | Klumpp, Jr. et al. | 174/153 |
| 3,464,659 | 9/1969 | Klumpp, Jr. et al. | 248/56 |
| 3,701,505 | 10/1972 | Klumpp, Jr. | 248/56 |
| 4,108,527 | 8/1978 | Douty et al. . | |
| 4,125,312 | 11/1978 | Aimar . | |
| 4,130,330 | 12/1978 | Chandler . | |
| 4,280,746 | 7/1981 | Ignatowicz | 439/470 |
| 4,488,769 | 12/1984 | Feigl . | |
| 4,516,822 | 5/1985 | Wolfel . | |
| 4,702,542 | 10/1987 | Noyes | 439/347 |
| 5,547,388 | 8/1996 | Hill | 439/135 |

*Primary Examiner*—Khiem Nguyen
*Attorney, Agent, or Firm*—Robert Kapalka

[57] ABSTRACT

The invention is a strain relief for an electrical connector which is terminated to a plurality of wires extending from the connector in a wire bundle. The strain relief comprises a housing which is mountable on the electrical connector, a barrel connected to the housing and arranged for nesting the wire bundle, a clamp which is applicable to the barrel to effect gripping of the wire bundle within the barrel, and the barrel being manipulable to release the clamp, thereby releasing the gripping of the wire bundle.

19 Claims, 4 Drawing Sheets

ADJUSTABLE AND RELEASABLE STRAIN RELIEF

FIELD OF THE INVENTION

The invention relates to a strain relief for an electrical connector.

BACKGROUND OF THE INVENTION

U.S. Pat. No. 4,125,312 discloses an electrical connector strain relief comprising a pair of similar half-shells which are adapted to be coupled together while surrounding a connector housing. Each of the half-shells includes a clamp portion, the pair of clamp portions being configured to clamp onto a cable exiting from the connector. The half-shells are molded from a plastic material, and at least one of the clamp portions has an integrally molded tongue that is insertable into a slot in the other of the clamp portions. The tongue has serrated edges which are configured to engage teeth within the slot, thereby securing the clamp portions together around the cable.

A problem with this strain relief is that the clamp portion is not adjustable in size to accommodate different sizes of cable. Another problem is that the tongue cannot be readily disengaged from the slot of the clamp portion, thereby making it difficult to reuse the strain relief. There is a need for a strain relief which is adjustable in size and easily reusable.

SUMMARY OF THE INVENTION

The invention is a strain relief for an electrical connector which is terminated to a plurality of wires extending from the connector in a wire bundle. The strain relief comprises a housing which is mountable on the electrical connector, a barrel connected to the housing and arranged for nesting the wire bundle, a clamp which is applicable to the barrel to effect gripping of the wire bundle within the barrel, and the barrel being manipulable to release the clamp, thereby releasing the gripping of the wire bundle.

In one embodiment, the strain relief comprises a housing which is configured to receive the electrical connector in an interior thereof. The housing includes first and second housing members which are hingedly connected together and movable relatively together and apart. Latch means are provided for securing the first and second housing members together in a closed position. The housing has an opening through which the wire bundle can extend, and a barrel connected to the housing is arranged for nesting the wire bundle exteriorly of the opening. The barrel includes first and second barrel members which are connected to respective ones of the first and second housing members and configured to straddle the wire bundle when the first and second housing housing members are in the closed position. A clamp is applicable to the barrel to effect gripping of the wire bundle within the barrel. The clamp is initially integral with the strain relief and is severable therefrom to permit application of the clamp to the barrel. The clamp is formed as a U-shaped member having a pair of arms that cooperate with one of the first and second barrel members by ratcheting engagement therewith, and this one barrel member is squeezable to release the ratcheting engagement. The clamp has a tongue which extends into the barrel for capturing the wire bundle between the tongue and the one barrel member.

BRIEF DESCRIPTION OF THE DRAWINGS

The invention will now be described by way of example with reference to the accompanying drawings in which.

DETAILED DESCRIPTION OF THE PREFERRED EMBODIMENT

Figure 1:
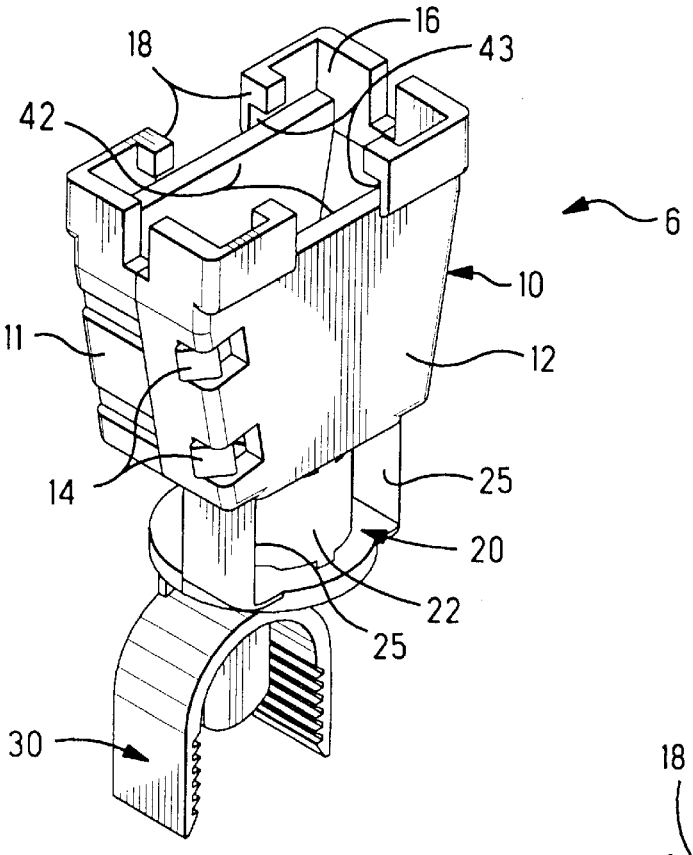
FIG. 1 is an isometric view of a strain relief according to the invention in a closed position.
Figure 2:
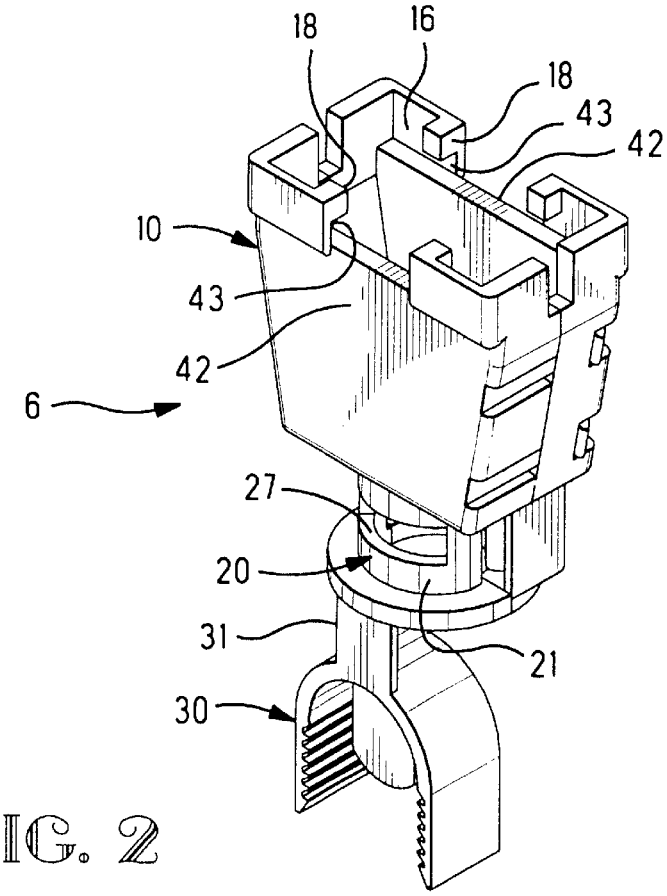
FIG. 2 is an isometric view of the closed strain relief from a different direction.
Figure 3:
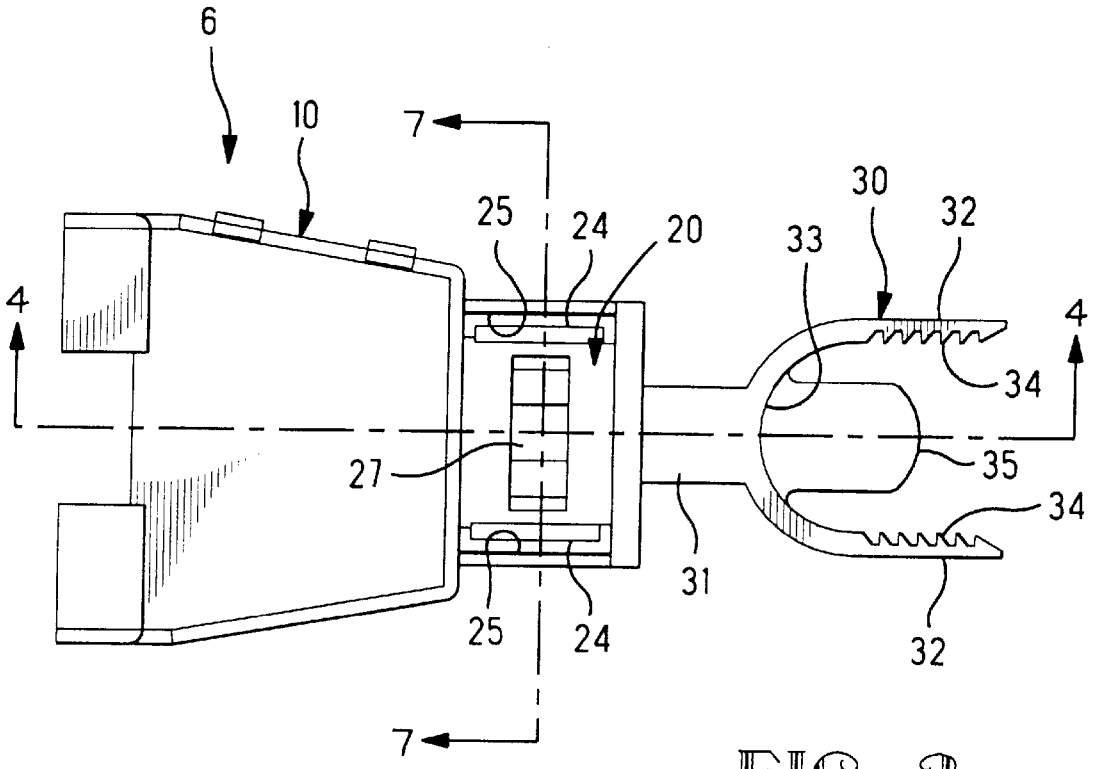
FIG. 3 is a plan view of the strain relief.
Figure 4:
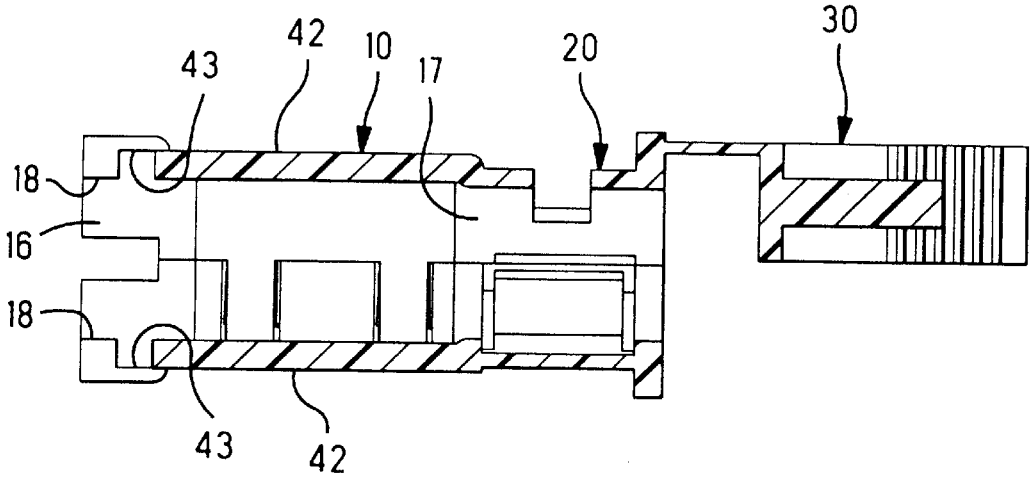
FIG. 4 is a cross-sectional view of the strain relief taken along line 4—4 of FIG. 3.

A strain relief according to the invention is useful with an electrical connector of the type having a plurality of contacts which are terminated to respective wires that extend from the connector in a cable or wire bundle. The strain relief prevents pullout of the wires from the contacts due to loads placed on the wire bundle, such as may be caused by pulling on the wire bundle in order to separate mated electrical connectors.

With reference to FIGS. 1–4, strain relief 6 comprises a housing 10, a barrel 20 and a clamp 30. The housing 10 has an interior space which is configured to accommodate an electrical connector therein. The housing has an open front 16 to permit the electrical connector therein to interconnect with a mating electrical connector. As best seen in cross-sectional view in FIG. 4, the housing has an opening 17 at a rear thereof which provides a passageway from an interior of the housing to an interior of the barrel. The wire bundle from the connector can extend through the opening 17, and the barrel 20 is arranged for nesting the wire bundle which exits the housing 10 through the opening. The housing 10 has lugs 18 which cooperate with walls 42 to define a pair of opposed grooves 43 that are configured to receive a flange of the electrical connector. When the strain relief is applied to the connector, a rearward axial load exerted on the wire bundle will cause the lugs 18 of the housing to engage a front surface of the connector flange, thereby transferring the axial load to the housing of the electrical connector and preventing pullout of the wires from the contacts in the connector.

Figure 5:
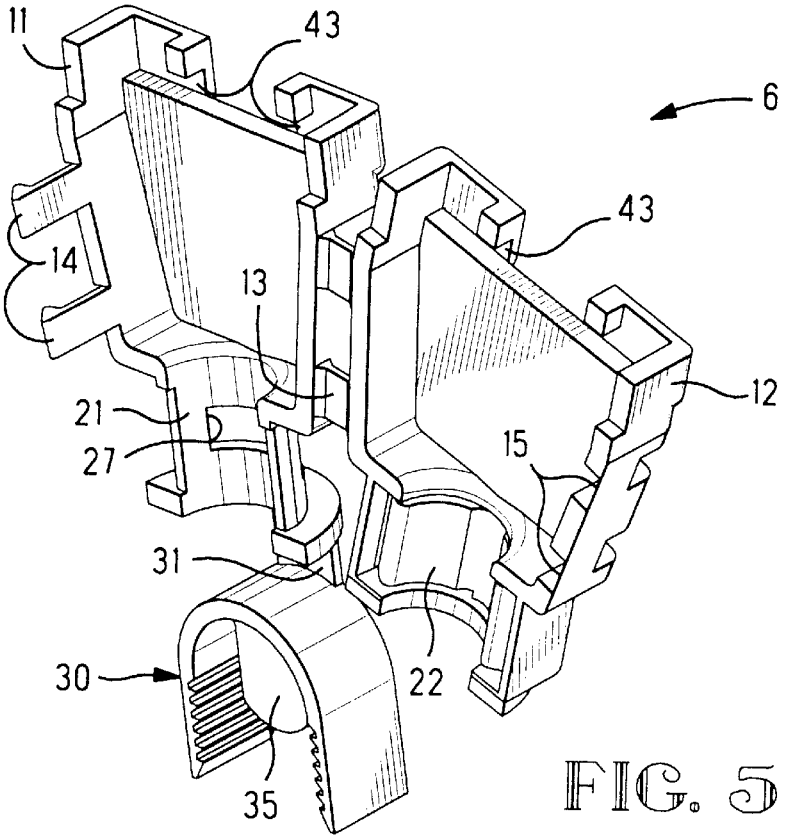
FIG. 5 is an isometric view of the strain relief in an open position.
Figure 6:
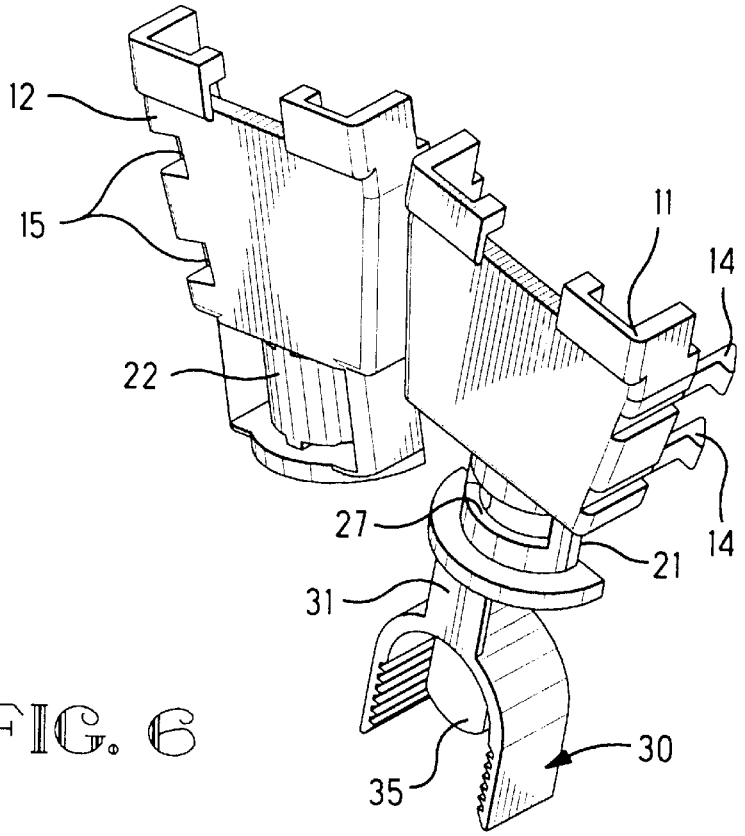
FIG. 6 is an isometric view of the open strain relief from a different direction.

As shown in FIGS. 5 and 6, the strain relief 6 is preferably molded from plastic material as a one-piece integral unit. The housing includes relatively movable first and second housing members 11, 12 which are hingedly connected by a flexible hinge 13. The first housing member 11 has latch arms 14 which are receivable in slots 15 in the second housing member 12 for securing the housing members together in a closed position around the electrical connector.

Figure 7:
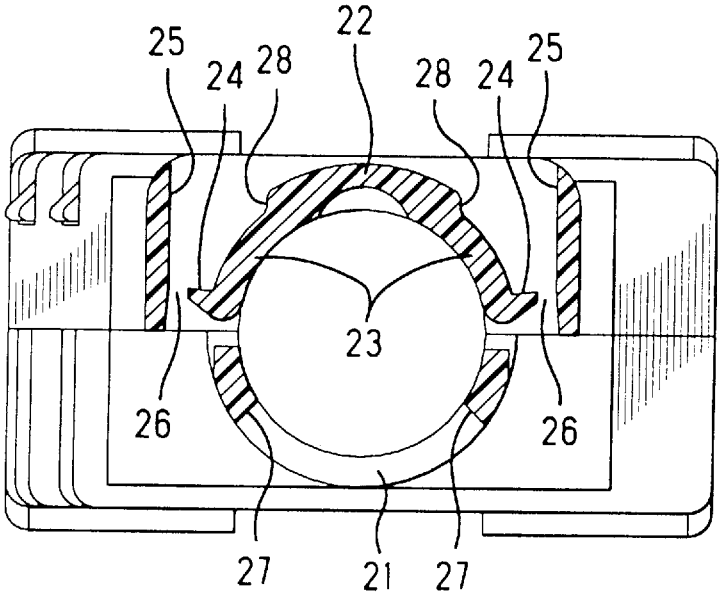
FIG. 7 is a cross-sectional view taken along line 7—7 of FIG. 3 and rotated 90° counter-clockwise, with a clamp shown disposed for application to the strain relief.
Figure 7:
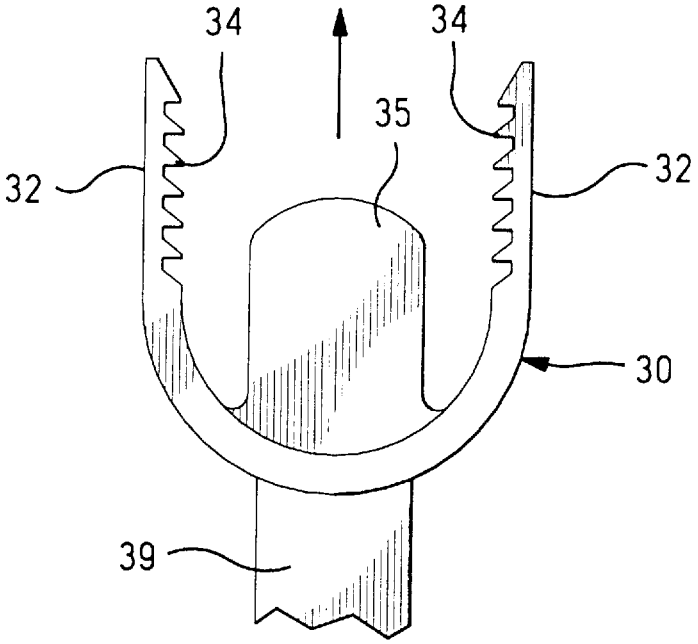

Similarly, the barrel 20 includes first and second barrel members 21, 22 which are connected to the housing members 11, 12, respectively. The barrel members 21, 22 are semi-circular so that the wire bundle can be easily nested between the barrel members when the strain relief is closed on the connector. The second barrel member 22 is somewhat flexible. As best seen in FIG. 7, opposite sides of the barrel member 22 serve as locking arms 23 each having a locking tooth 24 near an end thereof. The locking arms 23 are flanked by a pair of walls 25 so as to define pockets 26 outwardly of the locking teeth 24. The barrel member 21 has a hole 27 for a purpose that will be explained hereinbelow.

Referring back to FIGS. 2 and 3, the clamp 30 is connected to the barrel 20 by a short tether 31 which can be easily severed by a standard cutting tool so that the clamp 30 can be applied to the barrel 20 to effect gripping of the wire bundle within the barrel. However, it should be readily apparent that the tether 31 could be formed long enough so that the clamp could be applied to the barrel without severing the tether. The clamp 30 is preferably a U-shaped member having a pair of arms 32 interconnected by a base 33. Each of the arms has ratchet teeth 34. A tongue 35 extends from the base 33 between the arms 32.

Application of the strain relief to an electrical connector will now be described. An open strain relief as shown in FIG. 5 is folded around a terminated connector by pivoting the housing members 11, 12 around the hinge 13. Flanges of the connector are received in the grooves 43 and the wire bundle is received between the barrel members 21, 22. The housing members 11, 12 are secured in a closed position by the latch arms 14, as shown in FIG. 1. The tether 31 is severed, and the clamp 30 is applied to the barrel by installing the clamp open end first over the first barrel member 21, as shown in FIG. 7. The arms 32 enter the pockets 26 which are dimensioned so that the ratchet teeth 34 are urged into engagement with the locking teeth 24 by the walls 25. The tongue 35 passes through the hole 27 in the first barrel member 21 and compresses the wire bundle against the inner surface of the second barrel member 22. In this way, the tongue 35 along with the ratchet teeth 34 on the clamp which are in engagement with the locking teeth 24 on the second barrel member 22 provide a cooperable means for adjusting an interior dimension of the barrel 30 to effect gripping of different wire bundles having a range of sizes.

The walls 25 may be formed with converging surfaces so that the arms 32 are urged more closely together as the arms enter deeper into the pockets 26, thereby urging the ratchet teeth 34 more firmly into engagement with the locking teeth 24 so that the clamp 30 is held ever more tightly as the wire bundle is compressed.

The clamp can be released from the barrel by squeezing together the locking arms 23 of the barrel member 22 with a tool such as needle nose pliers, thereby disengaging the locking teeth 24 from the ratchet teeth 34 so that the clamp can be withdrawn. The locking arms 23 can be provided with surfaces 28 which are arranged to be squeezed to facilitate release of the clamp. By previously severing the tether 31 so that a remnant 39 is left attached to the clamp, a convenient grip tab is provided to facilitate withdrawal of the clamp.

The invention provides a strain relief that is adjustable to accommodate connectors having a wire bundle in a range of sizes. The strain relief has a clamp that is easily released to permit removal and reuse of the strain relief.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. A strain relief for an electrical connector which is terminated to a plurality of wires extending from the connector in a wire bundle, the strain relief comprising:

a housing which is mountable on the electrical connector, a barrel connected to the housing and arranged for nesting the wire bundle, the barrel including first and second barrel members which are movable from an open position for receiving the wire bundle therein, to a closed position wherein the wire bundle is straddled by the first and second barrel members, a clamp which is applicable to the barrel to effect gripping of the wire bundle within the barrel, the clamp including a U-shaped member having a pair of arms that are cooperable with one of the first and second barrel members to hold the clamp to the barrel, and a tongue extending from a base of the U-shaped member between the pair of arms, the tongue being cooperable with the one barrel member to engage the wire bundle therebetween.

2. The strain relief according to claim 1, wherein the pair of arms cooperate with the one barrel member by ratcheting engagement therewith.

3. The strain relief according to claim 2, wherein the one barrel member is squeezable to release the ratcheting engagement.

4. The strain relief according to claim 2, wherein the one barrel member is flanked by walls which are configured to urge the pair of arms into the ratcheting engagement.

5. The strain relief according to claim 1, wherein the tongue extends through a hole in the other of the first and second barrel members when the clamp is applied to the one barrel member.

6. The strain relief according to claim 1, wherein the clamp is initially integral with the strain relief and is severable therefrom to permit application of the clamp to the barrel.

7. A strain relief for an electrical connector which is terminated to a plurality of wires extending from the connector in a wire bundle, the strain relief comprising:

a housing which is configured to receive the electrical connector in an interior thereof, the housing having an opening through which the wire bundle can extend, a barrel connected to the housing and arranged for nesting the wire bundle exteriorly of the opening, a clamp including a U-shaped member having a pair of arms which are engageable with the barrel, and a tongue extending from a base of the U-shaped member between the pair of arms, the tongue being insertable through a hole in the barrel to engage the wire bundle within the barrel.

8. The strain relief according to claim 7, wherein the housing includes first and second housing members which are movable relatively together and apart.

9. The strain relief according to claim 8, wherein the first and second housing members are hingedly connected together.

10. The strain relief according to claim 8, further comprising latch means for securing the first and second housing members together in a closed position.

11. The strain relief according to claim 8, wherein the barrel includes first and second barrel members which are connected to respective ones of the first and second housing members and configured to straddle the wire bundle when the first and second housing housing members are in the closed position.

12. The strain relief according to claim 11, wherein the pair of arms cooperate with one of the first and second barrel members by ratcheting engagement therewith.

13. The strain relief according to claim 12, wherein the one barrel member is squeezable to release the ratcheting engagement.

14. The strain relief according to claim 13, wherein the one barrel member is flanked by walls which are configured to urge the pair of arms into the ratcheting engagement.

15. The strain relief according to claim 7, wherein the clamp is initially integral with the strain relief and is severable therefrom to permit application of the clamp to the barrel.

16. A strain relief for an electrical connector which is terminated to a plurality of wires extending from the connector in a wire bundle, the strain relief comprising:

a first barrel member arranged for nesting the wire bundle, a clamp including a U-shaped member having a pair of arms which are cooperable with the first barrel member to secure the clamp to the first barrel member, the clamp having a tongue extending from a base of the U-shaped member between the pair of arms, the tongue being cooperable with the first barrel member to engage the wire bundle therebetween, wherein the clamp is initially integral with the strain relief and is severable therefrom to permit application of the clamp to the first barrel member.

17. The strain relief according to claim 16, wherein the first barrel member is flanked by walls which are configured to urge the pair of arms into ratcheting engagement with the first barrel member.

18. The strain relief according to claim 17, wherein the first barrel member is squeezable to release the ratcheting engagement.

19. The strain relief according to claim 16, further comprising a second barrel member which cooperates with the first barrel member to straddle the wire bundle, and wherein the tongue extends through a hole in the second barrel member when the clamp is applied to the first barrel member.

* * * * *